United States Patent [19]

Maroszek

[11] 4,289,266

[45] Sep. 15, 1981

[54] ARTICLE CARRIER

[75] Inventor: Raymond V. Maroszek, Neenah, Wis.

[73] Assignee: American Can Company, Greenwich, Conn.

[21] Appl. No.: 105,115

[22] Filed: Dec. 19, 1979

[51] Int. Cl.[3] ..... B65D 5/02

[52] U.S. Cl. ..... 229/28 BC; 229/40; 229/52 BC; 206/165

[58] Field of Search ..... 229/52 B, 52 BC, 40, 229/28 BC, 3.5 MF; 206/165, 166

[56] References Cited

U.S. PATENT DOCUMENTS

| | | | |
|---|---|---|---|
| 2,300,492 | 11/1942 | Fischer | 229/28 BC |
| 2,314,895 | 3/1943 | Powell | 229/28 BC X |
| 2,314,896 | 3/1943 | Powell | 229/28 BC |
| 2,335,022 | 11/1943 | O'Reilly | 229/28 BC X |
| 2,345,567 | 4/1944 | Arneson | 206/165 X |
| 2,362,990 | 11/1944 | Crane | 229/28 BC X |
| 2,375,631 | 5/1945 | De Villard | 206/165 X |
| 3,182,794 | 5/1965 | Moore | 229/40 X |
| 3,239,126 | 3/1966 | Arslanian | 229/3.5 MF |
| 3,727,825 | 4/1973 | Troth | 229/DIG. 4 |
| 4,184,595 | 1/1980 | Wackerman | 206/427 X |

*Primary Examiner*—Davis T. Moorhead

*Attorney, Agent, or Firm*—Robert P. Auber; George P. Ziehmer; Harry W. Hargis, III

[57] ABSTRACT

A carrier for one or more stackable articles formed from a paperboard blank of generally rectangular configuration. The blank is folded about a score line intermediate its short ends so that adjacent regions are divergent at an angle. A pair of aligned slots in each adjacent region serve as a hand-hold. The blank further has confronting side panels extending downwardly from the adjacent, divergent regions, and panel portions cut from the side panels are folded toward one another along score lines adjacent free ends of the blank in formation of openings in the side panels, and are fastened to one another in provision of a bottom for the carrier. An article may be carried singly, or several stacked upon one another while supported on the bottom and projecting through, and retained within blank portions that define, the side-panel openings.

6 Claims, 4 Drawing Figures

ARTICLE CARRIER

BACKGROUND OF THE INVENTION

This invention relates to article carriers, and more particularly to a carrier for stackable articles, formed from a paperboard blank.

Articles to be carried typically are round or rectangular covered, stackable containers for so-called take-out foods. While bags or closed cartons have been provided, it has been found economical and convenient to provide a carrier of paperboard suitably cut and folded to form a bottom platform portion on which an article rests, open side panels through which an article protrudes in retention thereof, and an upper handle portion. Ornamental features of one such article carrier are disclosed and claimed in the copending Design Patent application of Raymond V. Maroszek et al, Ser. No. 094,399, filed Nov. 14, 1979, and assigned to the assignee of the present application. Ornamental features of the present article carrier are disclosed and claimed in my copending design patent application, Ser. No. 105,402, filed concurrently with, and assigned to the assignee of, the present application.

It is an objective of the present invention to provide an improved, economical article carrier structure.

It is a further objective of the invention to provide improved article carrier structure of paperboard or the like formed from a sheet thereof cut and folded in such manner as to make effective and economical use of the sheet.

SUMMARY OF THE INVENTION

In achievement of the foregoing as well as other objectives, the invention contemplates an improved carrier for one or more stackable articles, formed from a blank of paperboard or the like of generally rectangular configuration, wherein a score line is provided intermediate the short ends thereof about which said blank is folded so that regions of the blank adjacent the score line are divergent at an angle, the blank having a pair of elongate slots in the divergent regions of the blank, the slots being generally parallel to the score line and uniformly spaced therefrom, the blank further having a pair of openings in confronting side wall portions thereof intersecting the divergent regions along provided parallel score lines, and panel portions on the side wall portions cut therefrom to form the openings and folded toward one another about score lines that are parallel to one another, so that the panel portions are substantially coplanar and extend perpendicular to the plane of the parallel side wall portions, and means fastening the panel portions to one another in provision of an article carrier, wherein articles may be carried singly or stacked upon one another and supported on the fastened panel portions, while projecting through, and retained by portions of the side wall portions defining, said openings.

The manner in which objectives and advantages of the invention may best be achieved will be more fully understood from a consideration of the following description, taken in light of the accompanying drawing.

DESCRIPTION OF THE SEVERAL EMBODIMENTS

Figure 1:
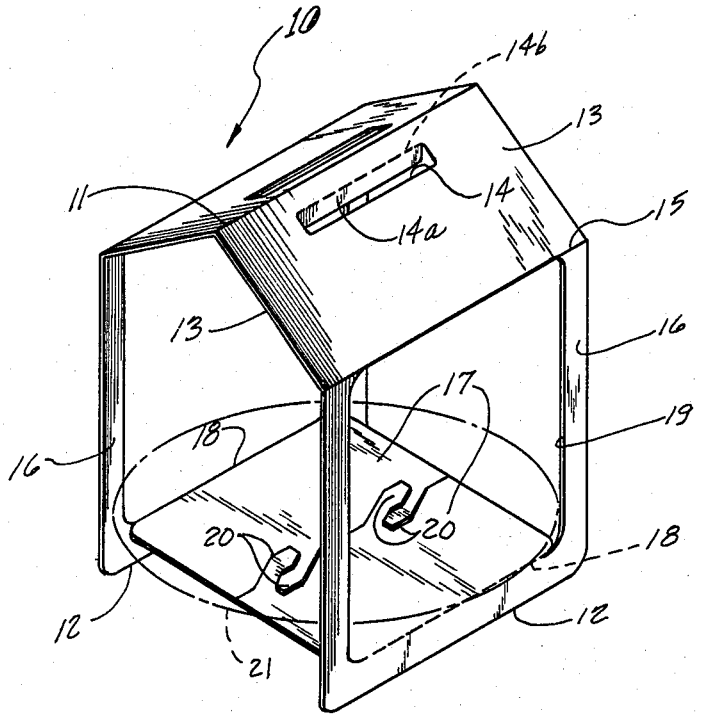
FIG. 1 is a perspective view of an article carrier embodying the invention, wherein an article is illustrated diagrammatically in broken lines.
Figure 2:
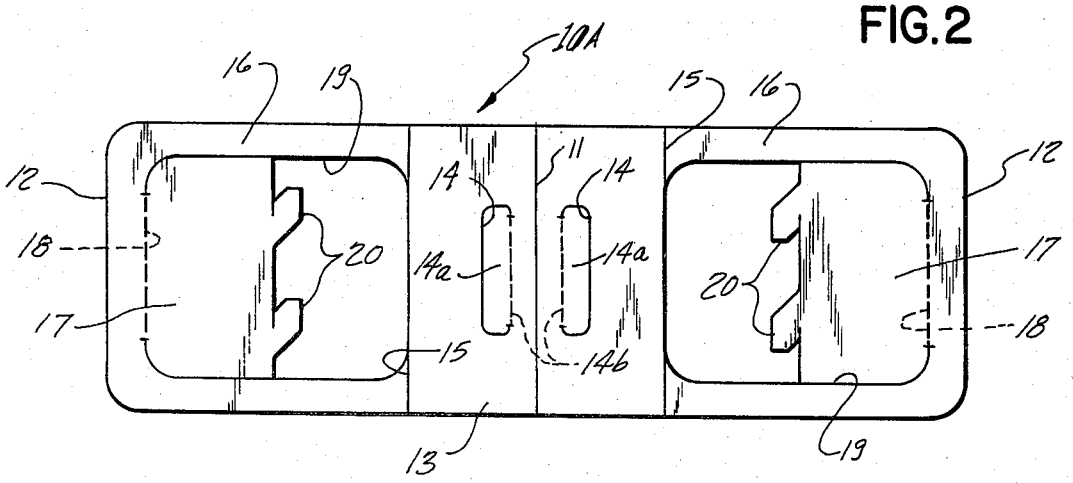
FIG. 2 is a plan view of a one-piece blank from which the article carrier of FIG. 1 is assembled.

With more detailed reference to the Drawing, the article carrier 10 seen in FIG. 1 is formed from the suitably cut and scored paperboard blank 10A of generally rectangular configuration seen in FIG. 2. While paperboard is the preferred material of the blank, it will be apparent from what follows that other materials, such as polyethylene or like plastic, or laminate sheets including paperboard, plastic, or metal foil, will be suitable for use in achieving objectives and advantages of the invention.

Referring to both FIGS. 1 and 2, the carrier is formed from blank 10A, wherein a score line 11 is provided intermediate the short ends 12 of the blank, and about which it is folded so that regions 13 of the blank adjacent the score line 11 are divergent at an angle. A pair of apertures such as elongate slots 14 are formed in blank 10A so that they extend generally parallel to score line 11 and are uniformly spaced therefrom in provision of a finger-hold for the carrier. Each slot 14 is formed by partially cutting out a blank portion 14*a*, and folding it inwardly of the carrier about a cut score line 14*b*. The apertures may, of course, be formed simply as round holes. A pair of score lines 15 are parallel to one another and to score line 11 from which they are equally spaced. Side wall portions 16 intersect regions 13 along the score lines 15 about which they are folded to extend vertically downwardly. Panel portions 17 are cut from side wall portions 16 and are folded toward one another about parallel cut score lines 18, so that the panel portions 17 are substantially coplanar and perpendicular to the plane of parallel side wall portions 16. Score lines 18 are distal from score line 11, are spaced from short ends 12, and are parallel to one another. Folded panel portions 17 are spaced from short ends 12, and leave a pair of openings 19 in the confronting side wall portions 16 of the set-up carrier in FIG. 1. While the panel portions 17 are of lesser size than the openings 19, it is to be understood that they may correspond in sizes to the openings, or more nearly so, selection of size being a matter of choice without departing from the spirit of the claimed invention.

Assembly of the carrier is maintained by locking means comprising aligned, but oppositely presented, sets of locking tabs 20 on each of the free edges of panel portions 17. A tab 20 of one panel portion is essentially the same as its aligned counterpart on the other panel portion, except that they are presented laterally in opposite directions relative to one another. The tabs are interlocked, at the point of use, by displacing the free edge portions of panel portions 17 laterally, overlapping them, and then sliding the tabs 20 toward one another, in interlocking relationship.

Construction and arrangement of the article carrier is such that articles, one of which is shown diagramatically in broken lines, and designated generally by the numeral 21, may be carried singly or stacked one upon the other and supported on the locked panel portions 17, while projecting through, and retained by side wall portions 16 of the blank that define, the openings 19. It will be also appreciated that stackable articles of different shapes (e.g. round or rectangular) and heights advantageously may be accommodated by the carrier.

Figure 3:
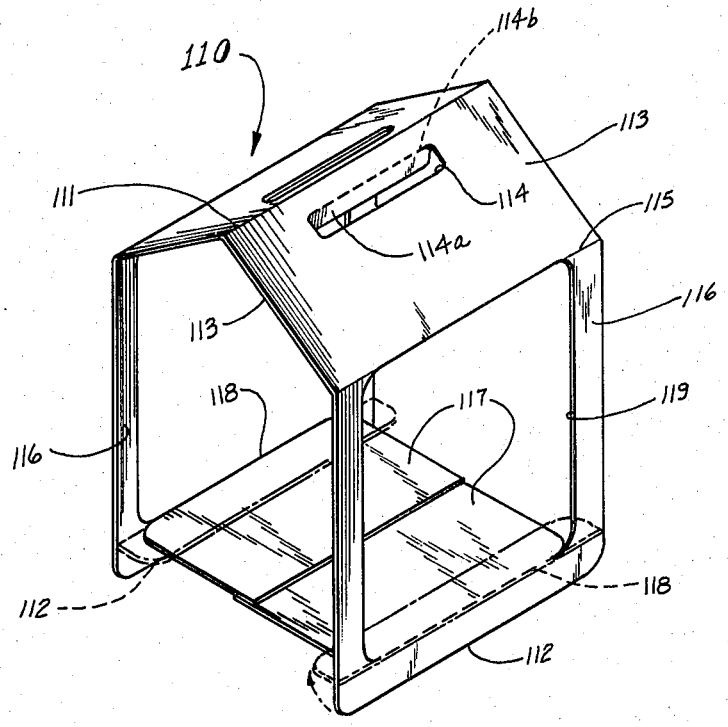
FIG. 3 is a perspective view similar to FIG. 1, and illustrating a modified embodiment of the invention.
Figure 4:
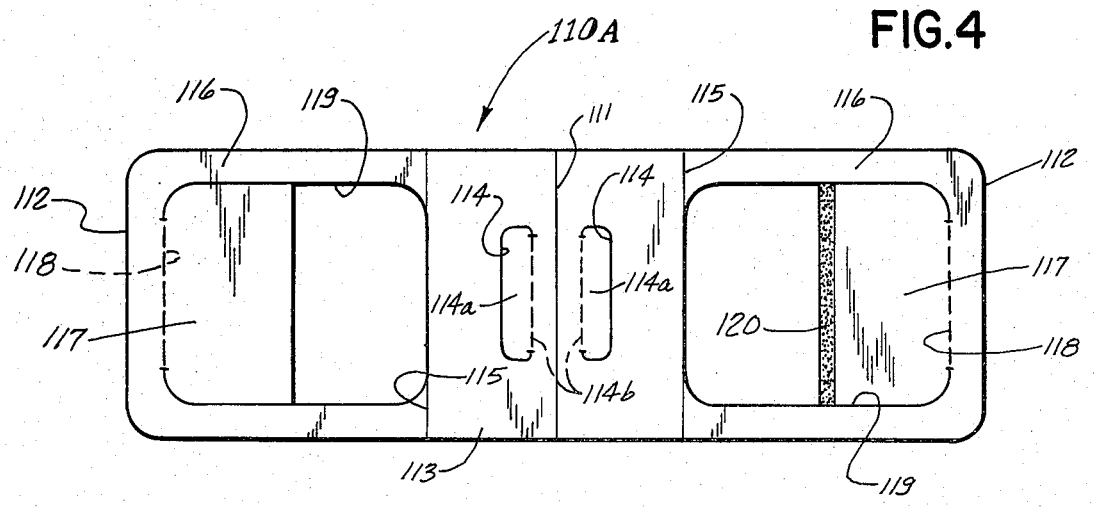
FIG. 4 is a plan view of a one-piece blank from which the article carrier of FIG. 3 is assembled.

In the modified embodiment of the invention, structure of the carrier 110 seen in FIG. 3, and the blank 110A seen in FIG. 4, is identical to the carrier and blank therefor seen in FIGS. 1 and 2, respectively, with the exception of the locking means on each of panel portions 117. For convenience of illustration, corresponding elements as between FIGS. 1, 2 and FIGS. 3, 4 are designated by the same numerals, except that numerals in FIGS. 3 and 4 are prefixed by the numeral 1.

More particularly, the modified locking means for panel portions 117 include regions of overlap adhered to one another by means of an adhesive strip designated generally by the numeral 120 in FIG. 4. Suitable adhesives comprise hot melt, cohesives, latex, and polyvinyl acetate. It is contemplated also that the means fastening the panel portion may comprise staples driven through, or tape applied to, the regions of overlap.

In either of the embodiments of the carrier, and as illustrated in FIG. 3 only, the strips between score lines 118 and short ends 112 of side wall portions 16 may be folded beneath panel portions 111, along score lines 118, and glued thereto either upon set up or at the time of formation of blank 10A or 110A, in achievement of provision for reinforcement of the floor of the article carrier.

The embodiments of the invention afford set up of the carriers either at the point of manufacture or at the point of use, while achieving economical utilization of any of the disclosed sheet materials.

While modified embodiments of the invention have been described, it will be understood that these as well as other modifications are contemplated by the scope of the appended claims.

I claim:

1. A carrier for one or more stackable articles, formed from a blank of flexible and resilient material of generally rectangular configuration wherein a first score line is provided intermediate the short ends of said blank about which said blank is folded so that regions of said blank adjacent said first score line are divergent at an angle, said blank having a pair of apertures in said divergent regions of said blank, said apertures being uniformly spaced from said first score line, said blank further having a pair of openings in confronting side wall portions thereof intersecting said divergent regions along provided parallel score lines, and panel portions on said side wall portions cut thereform to form at least portions of said openings and folded toward one another about second score lines that are distal from said first score line, are spaced from said short ends, and are parallel to one another, so that said panel portions are substantially coplanar, are spaced from said short ends, and extend perpendicular to the plane of said parallel side wall portions, and means fastening said panel portions to one another in provision of an article carrier, wherein articles may be carried singly or stacked upon one another and supported on said fastened panel portions, while projecting through, and retained by portions of said wall portions defining, said openings.

2. The carrier of claim 1, wherein said apertures comprise elongate slots that extend generally parallel to said first score line.

3. The carrier of claim 1 or 2, wherein said means fastening said panel portions to one another comprise interlocking tabs on free edge portions of said panel portions.

4. The carrier of claim 1 or 2, wherein said panel portions include regions of overlap, and said means fastening said panel portions to one another comprises an adhesive adhering same in said regions of overlap.

5. The carrier of claim 1 or 2, wherein said panel portions include regions of overlap, and said means fastening said panel portions to one another comprises staple means driven through said regions of overlap.

6. The carrier of claim 4, wherein said adhesive is selected from the group consisting of hot melt, cohesive, latex and polyvinyl acetate.

* * * * *